US005351465A

United States Patent [19]

Fortnam et al.

[11] Patent Number: 5,351,465

[45] Date of Patent: Oct. 4, 1994

[54] SPREADING DEVICE AND METHOD FOR PARTING CONTAINERS

[75] Inventors: Robert W. Fortnam; Charles C. Austin, both of Nashua, N.H.

[73] Assignee: Austin-Gordon Design, Inc., Nashua, N.H.

[21] Appl. No.: 46,018

[22] Filed: Apr. 12, 1993

[51] Int. Cl.[5] ..... B65B 43/26; B65B 13/32

[52] U.S. Cl. ..... 53/492; 53/384.1; 53/459; 53/468

[58] Field of Search ..... 53/381.1, 381.2, 381.5, 53/382.1, 384.1, 459, 468, 492, 570

[56] References Cited

U.S. PATENT DOCUMENTS

| | | | |
|---|---|---|---|
| 2,601,480 | 6/1952 | Williams | 53/384.1 |
| 2,969,629 | 1/1961 | Blais | 53/384.1 |
| 2,973,612 | 3/1961 | McGowan | 53/384.1 |
| 3,243,937 | 4/1966 | Ragan | 53/384.1 |
| 4,078,358 | 3/1978 | Henderson | 53/468 |

*Primary Examiner*—W. Donald Bray

*Attorney, Agent, or Firm*—Lahive & Cockfield

[57] ABSTRACT

A method and apparatus for parting containers comprising a first strip spring and a second strip spring, each strip spring extending along a first axis. The two strip springs have substantially flat first ends that are joined together, and substantially bowed second ends. The second ends of the first and second strip springs are bowed in a substantially concave configuration relative to the first axis. A guide block having a groove formed therethrough receives the two strip springs and places the springs in intimate facing contact with each other. The guide block groove extends for a short distance along the first axis, and the strip springs are adapted to slide through the groove along the first axis. When the strip springs move relative to the guide block along the first axis in a direction away from the first ends, the second ends of the strip springs move into close juxtaposition with each other, and when the strip springs move relative to the guide block in the opposite direction the strip spring second ends spread apart.

20 Claims, 4 Drawing Sheets

SPREADING DEVICE AND METHOD FOR PARTING CONTAINERS

BACKGROUND OF THE INVENTION

This invention relates generally to the field of container spreading apparatuses. In particular, the invention concerns an improved device for spreading open a container.

Today, large consumer demand for products places pressure on manufacturers to meet this demand. A product area that is presently experiencing a large increase in consumer demand is the field of breakfast products, e.g., cereals. Producers and manufacturers of cereal products strive to meet this increased demand by designing and implementing automated systems capable of producing and packaging cereal in large quantities. However, this increased automation has produced a separate and distinct set of problems concerning the integration and functionality of system components.

During a typical cereal packaging process, a flexible pouch is placed within a protective outer carton. A filler apparatus places cereal into the resilient pouch. Additionally, if advertising considerations warrant, a premium, e.g., a coupon or a three dimensional toy can be placed inside the flexible pouch along with the cereal.

Known devices suitable for opening or parting the flexible pouch so as to allow the pouch to receive the cereal or premium include triangular plungers or bobbins. Usually, the plungers are placed at opposite ends of the pouch and biased downward into the pouch. Upon insertion into the pouch, the increasing cross-section of the plungers causes the slack side panels of the pouch to become taut, allowing a predetermined amount of cereal to be received therein. Normally, the system operator must monitor the placement of the plungers into the pouch.

A problem with the foregoing design is that the plungers often tear the pouch, thereby spilling the cereal product. Such a design results in excessive amounts of product and packaging waste, and a corresponding loss of man-hours in removing the destroyed packaging and lost product. Another problem with the above design is that the plungers may not adequately spread the pouch if the improper plunger is selected, and not properly adjusted. This failure to properly spread the pouch results in an improper filling of the pouch with cereal. Finally, the prior device requires the system operator to constantly monitor and adjust the plunger during operation.

As the above-described and other prior art spreading apparatuses have proven less than optimal, an object of this invention is to provide an improved apparatus for spreading open a pouch or container.

Another object of the invention is to provide a reliable and effective spreading apparatus.

Still another object of the invention is to eliminate the need for operator judgment during the spreading and filling process.

Yet another object of the invention is to provide an apparatus that requires no adjustments notwithstanding the use of different size pouches.

Still yet another object of the invention is to provide a relatively cost effective spreading apparatus that is easily integrated with existing assembly line machinery.

Other general and more specific objects of the invention will in part be obvious and evident from the drawings and description which follows.

SUMMARY OF THE INVENTION

These and other objects of the invention are attained by the invention, which provides a method and apparatus for parting containers.

In one aspect the invention includes a first strip spring and a second strip spring, each spring extending along a first axis. The two strip springs have substantially flat first ends that are joined together, and substantially bowed second ends. In one embodiment, the second end of the first strip spring is bowed in a substantially concave configuration relative to the first axis, and the second end of the second strip spring is also bowed in a substantially concave configuration relative to the first axis. A guide block having a groove formed therethrough receives the two strip springs and places the springs in intimate facing contact with each other. The guide block groove extends for a short distance along the first axis.

In operation, when the first and second strip springs slide relative to the guide block along the first axis in a direction away from the first ends, the second ends of the strip springs move into close juxtaposition with each other, and when the block is moved in the opposite direction the strip spring second ends spread apart.

The first ends of the two strip springs may be joined in any conventional fashion, as for example, by bolting or clamping. In another preferred embodiment the first ends of the strip springs have formed therethrough apertures that overlay each other. The two apertures receive a threaded nut and bolt assembly.

Typically, the spreading device described above is used to part a waxed paper or plastic film pouch contained within an outer protective carton.

Further aspects of the invention may be determined from the above summary and from the description which follows.

BRIEF DESCRIPTION OF THE DRAWINGS

The foregoing and other aspects of the invention may be more fully understood from the following description, when read together with the accompanying drawings in which.

DESCRIPTION OF ILLUSTRATED EMBODIMENTS

Figure 1:
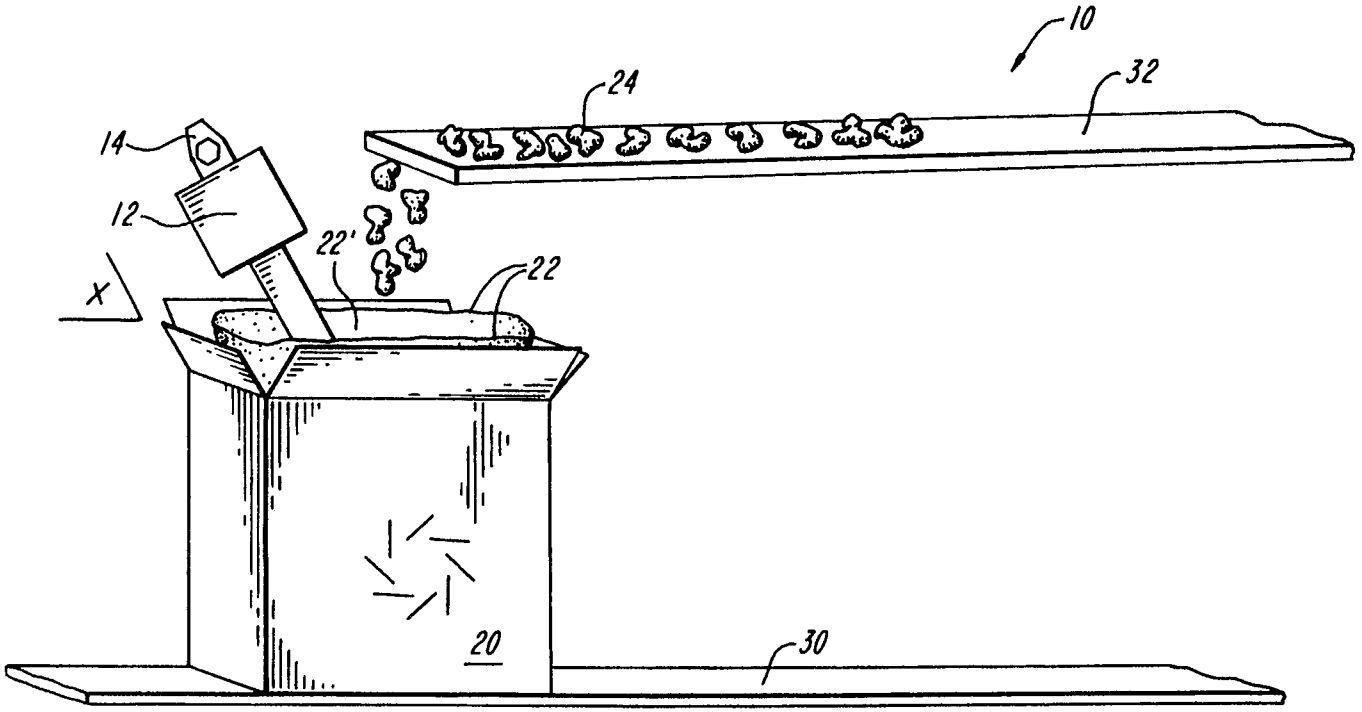
FIG. 1 is a diagrammatic illustration of an embodiment of the spreading device of the present invention in operation with a cereal packaging system.

FIG. 1 depicts a packaging system 10, with which the spreading device of the present invention is designed to be used. It should be understood, however, that the spreading device is not intended to be restricted to use with the packaging of cereal products only. Rather, the present invention can be utilized in any application requiring that a generally flexible container be biased open.

In FIG. 1, a typical cereal packaging system 10 includes a container transport 30 and a product transport 32. The system 10 further comprises a container 20 that is conveyed by the transport 30 to a predetermined location, as well as a product 24, e.g., cereal, that is carried by the product transport 32. The spreading device 12,14 of the present invention is disposed above the container 20, e.g., a cereal box. A flexible pouch 22 with an open mouth 22' located at the top is disposed within the cereal box 20.

The system 10 includes several fundamental elements of an overall system, and the partial system depicted in FIG. 1 illustrates the operating environment of the present invention. The spreading device 12,14 may be maintained in a stationary position above the cereal box 20 by any number of conventional means. For example, the spreader can be bolted to a rod that is slidable between a first and a second position. According to a preferred embodiment of the invention, the strip spring 14 (only one is shown) and the guide block 12 of the spreading device can be bolted to an actuating arm 48 that is mechanically coupled to a pneumatically operated air cylinder 50 (see FIG. 2).

The cereal box 20 is carried by the transport 30 to a selected position located underneath the spreading device and the cereal transport 32. The strip springs 14 are then translated downward through the guide block 12, by the action of the air cylinder 50. When the springs 14 are disposed in this extending position relative to the guide block 12, the springs are spread apart, thereby parting the pouch 22 located within the cereal box 20. The spreading action of the springs 14 opens the pouch a predetermined distance. This distance is only limited by the configuration of the container 20 and the actual spreading distance of the springs 14. The product transport 32 then delivers the cereal 24 or other product, e.g., a premium, to the box 20 for filling. After a predetermined amount of cereal 24 is delivered to the cereal box 20, the air cylinder 50 biases the springs 14 upward into a retracted position. In this position, the springs 14 are disposed in close juxtaposition with one another, thereby allowing the pouch to deform back to an original configuration. In a preferred embodiment, the box 20 is constructed of fabricated cardboard and the pouch 22 is made of waxed or plastic coated paper, or plastic film.

Figure 2:
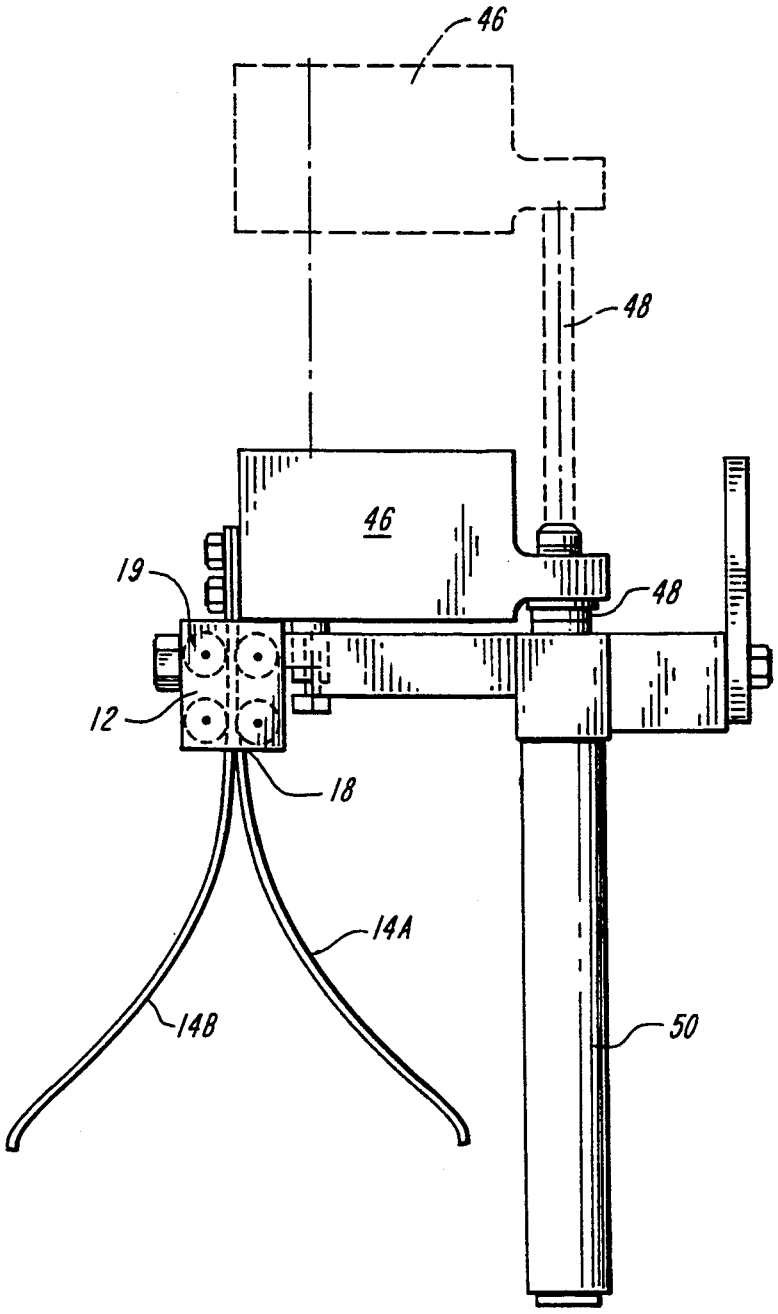
FIG. 2 shows a plan view of an actuating system that operates the spreading device of the present invention.
Figure 3A:
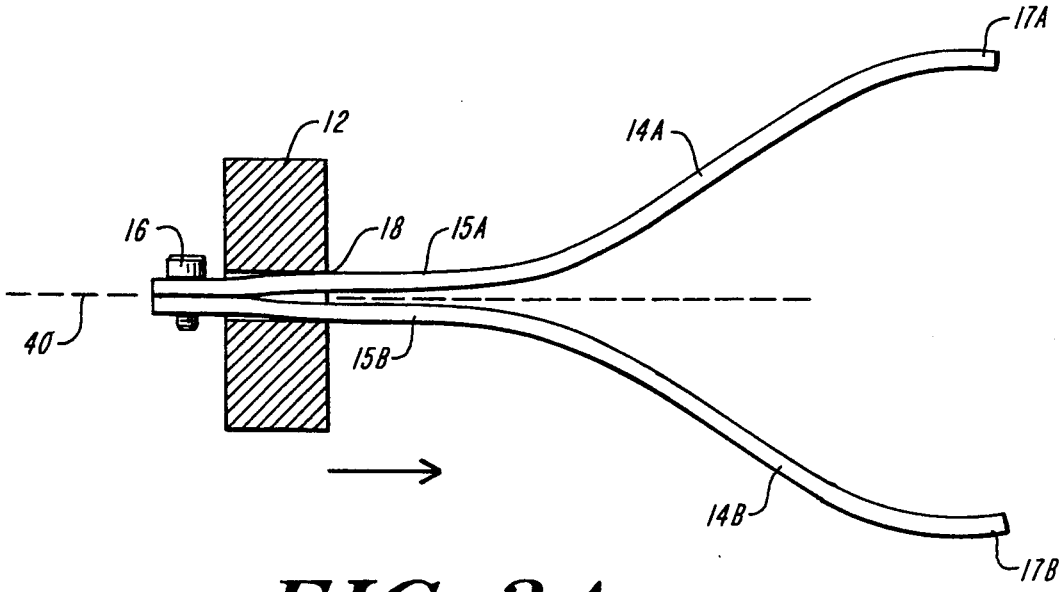
FIG. 3 A shows a cross-sectional plan view of the spreading device of the present invention when biased into an extended position.
FIG. 3B shows a cross-sectional plan view of the spreading device of the present invention when biased into a retracted position.
Figure 3B:
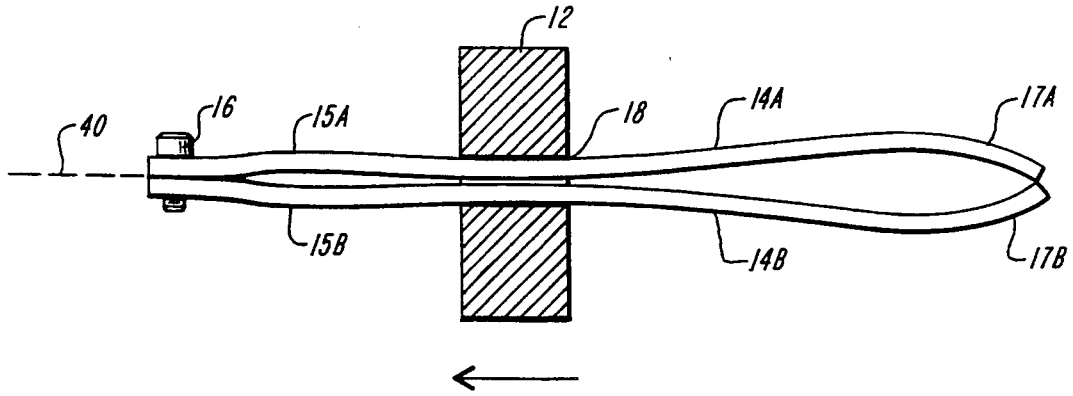

FIGS. 2 through 3B illustrate the operation of the spreading device of the present invention. FIG. 3A shows a first strip spring 14A having a substantially flat first end 15A and a substantially bowed second end 17A. Likewise, a second strip spring 14B has a substantially flat first end 15B and a substantially bowed second end 17B. The two strip springs 14A,14B lie along a first axis 40. The second end 17A of the first strip spring 14A is bowed in a substantially concave configuration relative to the first axis 40, and the second end 17B of the second strip spring 14B is bowed in a substantially concave configuration with respect to the first axis 40. The strip springs 14A,14B pass through a groove 18 formed through the guide block 12. In a preferred embodiment, the guide block 12 is fixed with respect to the strip springs 14A,14B. The guide block groove 18 places the strip springs 14A,14B in intimate facing contact with one another (see FIGS. 3A and 3B). The strip spring first ends 15A,15B are joined together, preferably by a bolt assembly 16, which passes through a pair of apertures (not shown) located in the first ends 15A,15B of the first and second strip springs 14A,14B. The strip spring first ends 15A,15B are coupled to an intermediate block 46. An actuating arm 48, e.g., a piston rod, couples an air cylinder 50 to the intermediate block 46.

Referring to FIG. 2, the first and second strip springs 14A,14B are alternately disposable between an extended position and a retracted position by the operation of the air cylinder 50. For example, when the air cylinder 50 applies an upward pneumatic force on the actuating element 48, the strip springs 14A,14B move upward through the guide block 12 via the intermediate block 46 to the retracted position. Similarly, the strip springs 14A,14B move downward through the guide block 12 when the air cylinder 50 supplies a downward biasing force to the actuating arm 48 (extended position).

The groove 18 has dimensions sufficient to allow the first and second strip springs 14A,14B to freely slide therethrough while simultaneously placing the strip springs 14A,14B in intimate contact with one another. In a preferred embodiment, the guide block groove is 0.19 inches by 0.395 inches, and contains small pulleys 19 to reduce operating friction.

FIG. 3A shows the strip springs 14A,14B disposed in the extended position referred to above. To attain this position, the strip springs 14A,14B move along the first axis 40, in the direction of the arrow, until the guide block 12 reaches a maximum position at the strip spring first ends 15A,15B. Preferably, the strip springs translate approximately 4 inches along the first axis. Absent the confining space of the guide block groove 18, the bowed configuration of the strip spring second ends 17A,17B causes the springs 14A,14B to spread apart. In a preferred embodiment, the first and second strip springs 14A,14B flare away from the first axis and the springs are 6.94 inches long, and the second ends 17A,17B spread apart 4.5 inches.

FIG. 3B shows the spreading device of the present invention disposed in the retracted position. When the strip springs 14A,14B move along the first axis 40 in the direction of the arrow (right to left), the strip springs 14A,14B slide through the groove 18. This movement of the strip springs, coupled with the bowed configuration of the first and second strip spring second ends 17A,17B, places the tips of the second ends in substantially close juxtaposition with each other.

Figure 4A:
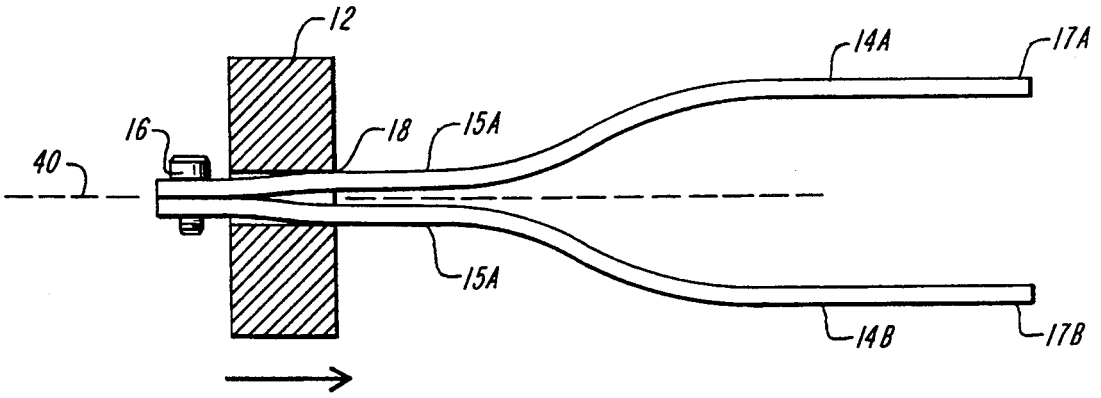
FIG. 4A shows a cross-sectional plan view of the spreading device according to an alternate embodiment of the present invention when biased into an extended position.

In an alternate embodiment, the spreading device of the present invention may have differently configured second ends 17A,17B. FIG. 4A shows the strip spring second ends 17A,17B bowed in a substantially concave configuration. Again, the strip springs 14A,14B pass through the groove 18 formed through the guide block 12. The groove 18 places the strip springs 14A,14B in intimate facing contact with one another.

Figure 4B:
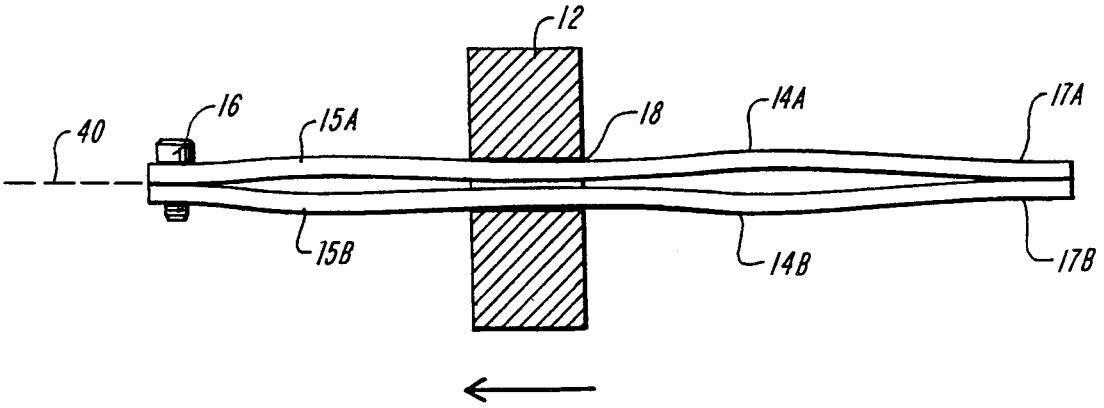
FIG. 4B shows a cross-sectional plan view of the spreading device according to an alternate embodiment of the present invention when biased into a retracted position.

FIG. 4B shows the spreading device of the alternate embodiment disposed in the retracted position. When the strip springs move along the first axis 40 in the direction of the arrow (right to left), the strip springs 14A,14B are pressed together by the groove 18. This constraining force when coupled with the bowed configuration of the strip spring second ends 17A,17B, moves the tips of the second ends 17A,17B towards each other.

In operation, the transport 30 carries the cereal box 20 to a position beneath the strip springs 14A,14B. According to a preferred embodiment, the guide block 12 is disposed one inch above the top of the cereal box 20 and pouch 22. Furthermore, the guide block 12 and the top of the cereal box 20 form an angle x (see FIG. 1). The guide block 12 can be disposed at any angle between 0–180 degrees; and preferably at a 45 degree angle. The air cylinder 50 pneumatically biases the strip springs second ends 17A,17B downward into the pouch 22. When biased into this extended position, the strip spring second ends 17A,17B spread apart thereby parting the top edges of the pouch 22. The cereal 24 and/or premium can now be delivered to the pouch 22, either by the transport 32 or by any other suitable means. Once the cereal and premium filling operation is complete, the air cylinder 50 pneumatically biases the actuating arm 48 upward. As a result, the strip springs 14A,14B move upward through the groove 18 of the guide block 12. The groove 18 presses the strip springs in intimate facing contact with each other. As the first ends of the strip springs 15A,15B move along the first axis 40, the guide block 12 forces the strip spring second ends 17A,17B towards each other. The pair of oppositely situated pulleys or rollers reduce the translational friction. The springs are then removed from the pouch 22, and the process is completed.

The various devices described can be formed of materials which are generally known to those of ordinary skill in the art. The sliding block 12 can be formed of any suitable material sufficient to allow repeated movement of the strip springs without causing excessive wear, and preferably is made from either oilite bronze or aluminum. Additionally, the strip springs 14A,14B can be formed of any suitable spring material such as heat treated blue spring steel.

In accordance with the above description, the invention attains the objects set forth. It is further intended that all matter and the description and drawings be interpreted as illustrative and not in a limiting sense. While various embodiments of the invention have been described in detail, other alterations obvious to those skilled in the art are intended to be embraced within the spirit and scope of the invention. For example, each strip spring may contain a plurality of axially spaced concaves. The invention is to be defined, therefore, not by the preceding detailed description but by the claims that follow.

What is claimed as new and desired to be secured by Letters Patent is:

1. A spreading device for opening the mouth of flexible containers, said device comprising a first strip spring having a substantially flat first end and a bowed second end extending along a first axis, a second strip spring having a substantially flat first end and a bowed second end extending along said first axis, means for joining together said first strip spring first end and said second strip spring first end, and a guide block having a groove formed therethrough for receiving each said first and second springs simultaneously, and positioning said first and second strip springs in intimate facing contact with each other, said groove extending along said first axis, whereby moving said strip springs relative to said guide block along said first axis in one direction relative to said first ends causes said first and second strip spring second ends to move into close juxtaposition with one another, and moving said strip springs relative to said guide block in the opposite direction causes said second ends to move away from one another forming a spreading action.

2. A device according to claim 1, wherein said guide block is arranged for moving said strip springs through said guide block groove such that said strip spring first ends move away from said guide block along said first axis causing said first and second strip spring second ends to move into close juxtaposition with one another, and moving said strip springs through said guide block groove in the opposite direction causes said strip spring second ends to move away from one another forming a spreading action.

3. A device according to claim 1, wherein said second ends of said first and second strip springs are bowed in a substantially concave configuration relative to said first axis.

4. A device according to claim 1, wherein said second ends of said first and second strip springs are configured to flare away from said first axis.

5. A device according to claim 1, wherein said first end of said first spring has a first aperture formed therethrough and said first end of said second spring has a second aperture formed therethrough, said first and second apertures overlying each other respectively, wherein said device includes fastening means for joining said first end of each said first and second springs together via said first and second apertures.

6. A device according to claim 1, wherein said guide block further comprises friction reduction means for reducing the friction between said strip springs and said groove when said strip springs translate through said groove.

7. A device according to claim 6, wherein said friction reduction means comprises one or more rollers.

8. A device according to claim 5, wherein said fastening means comprises a threaded nut and bolt assembly.

9. A device according to claim 1 wherein said guide block is selected from the group consisting of oilite bronze, aluminum, and extruded plastic.

10. A device according to claim 1 wherein said container comprises a pouch.

11. A device according to claim 10 wherein said pouch is selected from the group consisting of waxed paper, plastic coated paper, plastic film, and foil.

12. A method of parting a flexible container comprising the steps of providing a first strip spring having a first end and a second end and extending along a first axis, said first end being substantially flat and said second end being bowed relative to said first axis, providing a second strip spring having a first end and a second end and extending along said first axis, said first end being substantially flat and said second end being bowed relative to said first axis, providing a guide block having a groove formed therethrough for receiving each said first and second strip springs and positioning said first and second strip springs in intimate facing contact with each other, said groove extending along said first axis, joining together said first strip spring first end and said second strip spring first end, moving said strip springs relative to said guide block in one direction relative to said strip spring first ends causes said first and second strip spring second ends to move into close juxtaposition with one another, and alternately in a second direction opposite to said first direction, thereby causing said second ends to move away from one another in a spreading action.

13. A method according to claim 9 wherein said guide block is arranged for moving said strip springs through said guide block groove such that said strip spring first ends move away from said guide block along said first axis causing said first and second strip spring second ends to move into close juxtaposition with one another, and moving said strip springs through said guide block groove in the opposite direction causes said strip spring second ends to move away from one another forming a spreading action.

14. A method according to claim 12 wherein said second ends of said first and second strip springs are bowed in a substantially concave configuration relative to said first axis.

15. A method according to claim 12 wherein said second ends of said first and second strip springs are arranged to flare away from said first axis.

16. A method according to claim 12 wherein said container comprises a pouch.

17. A method according to claim 16 wherein said pouch is selected from the group consisting of waxed paper, plastic coated paper, plastic film and foil.

18. A method according to claim 12 wherein said guide block comprises friction reduction means for reducing friction between said strip springs and said groove as said strip springs translate therethrough.

19. A method according to claim 12 wherein said friction reduction means comprises one or more rollers.

20. A spreading device for opening the mouth of flexible containers, said device comprising a first strip spring extending along a first axis and having a first end and a second end, a second strip spring extending along said first axis and having a first end and a second end, means for joining together said first strip spring first end and said second strip spring first end, a guide block having a groove formed therethrough for receiving each said first and second springs simultaneously, and positioning said first and second strip springs in intimate facing contact with each other, said groove extending along said first axis, and said second ends of said first and second strip springs being bowed relative to said first axis, whereby moving said strip springs relative to said guide block along said first axis in one direction relative to said first ends causes said first and second strip spring second ends to move into close juxtaposition with one another, and moving said strip springs relative to said guide block in the opposite direction causes said second ends to move away from one another forming a spreading action.

* * * * *